US006848291B1

(12) United States Patent
Johnson et al.

(10) Patent No.: US 6,848,291 B1
(45) Date of Patent: Feb. 1, 2005

(54) PRESS BRAKE TOOL AND TOOL HOLDER

(75) Inventors: Paul T. Johnson, Stillwater, MN (US); Bryan L. Rogers, Forest Lake, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 10/778,296

(22) Filed: Feb. 13, 2004

(51) Int. Cl.[7] ..... B21D 37/04; B21D 37/14

(52) U.S. Cl. ..... 72/482.2; 72/481.1; 72/482.1; 72/482.92

(58) Field of Search ..... 72/481.1, 481.2, 72/481.3, 481.6, 481.9, 482.1–482.8, 482.91, 482.92, 482.93

(56) References Cited

U.S. PATENT DOCUMENTS

| | | | | |
|---|---|---|---|---|
| 2,755,758 A | | 7/1956 | Johansen | 113/49 |
| 4,993,255 A | | 2/1991 | Treillet | 72/462 |
| 5,460,027 A | | 10/1995 | Takahashi | 72/481 |
| 5,619,885 A | * | 4/1997 | Kawano et al. | 72/481.8 |
| 5,642,642 A | * | 7/1997 | Kawano | 72/482.91 |
| 5,782,308 A | | 7/1998 | Latten et al. | 72/481.6 |
| 6,138,492 A | | 10/2000 | Vining et al. | 72/481.1 |
| 6,151,951 A | * | 11/2000 | Kawano | 72/481.2 |
| 6,494,075 B1 | | 12/2002 | Pelech, Jr. | 72/481.1 |
| 6,564,611 B2 | * | 5/2003 | Harrington et al. | 72/481.2 |

FOREIGN PATENT DOCUMENTS

| | | | |
|---|---|---|---|
| EP | 237800 | * | 9/1987 |
| FR | 2691652 | * | 5/1992 |

* cited by examiner

*Primary Examiner*—David B. Jones
(74) *Attorney, Agent, or Firm*—Fredrikson & Byron, P.A.

(57) ABSTRACT

A press brake tool and tool holder. The tool is provided having a body that terminates downwardly in a work piece engaging surface and that includes a tang extending upwardly from the body for reception in a tool holder. The tang has a first wall defining a vertical surface for engagement with a cooperating vertical surface of a tool holder, and a second wall on the reverse side of the tang that defines an arcuate, concave surface engagable with a clamp of the tool holder. The concave surface includes an upper contact surface tangent to a plane that is downwardly convergent with respect to the vertical surface such that a force delivered to the contact surface includes an upward component tending to lift the tang into the tool holder. The upper contact surface may be formed on a first radius about a horizontal axis and is tangent to a first plane that is downwardly convergent with respect to said vertical surface. The concave surface may include a lower contact surface formed on a second, larger radius about a horizontal axis and that is tangent to a second plane that is upwardly convergent with respect to said vertical surface, the angle between the vertical and said first plane being greater than the angle between the vertical and the second plane so that the clamp delivers a net upwardly force to the tool.

15 Claims, 3 Drawing Sheets

PRESS BRAKE TOOL AND TOOL HOLDER

FIELD OF THE INVENTION

This invention relates to press brake technology, and particularly to tools and tool holders used in various press brakes.

BACKGROUND OF THE INVENTION

Press brakes are employed to bend metal sheets into desired configurations. A press brake commonly is equipped with a lower table and an upper table, one or both of which are moveable to close the tables upon a workpiece positioned between the tables. Forming tools are mounted to the tables so that when the tables are brought together, a work piece between the forming tables is bent into an appropriate shape. The upper table commonly includes a male forming tool having a lower work piece-deforming portion of a desired shape, such as a right angled bend, and the lower table commonly has an appropriately shaped and aligned die, which for example may be V-shaped and open upwardly to receive the work piece-deforming portion of the upper tool. A metal sheet positioned between the tool and die thus is pressed into a desired shape. Forming tools and dies commonly are horizontally elongated so that work pieces of various widths can be accommodated.

It is often necessary to exchange forming tools and dies to accommodate different bending operations. The dies, commonly resting on the lower table of a press brake, are readily removed and exchanged for others. The forming tools that are mounted to the upper table of a press brake often are not so easily replaced, however. Tool holders that are carried by the upper table commonly make use of a clamp that clamps upon an upwardly extending tang of a forming tool to hold the tool in the holder.

Tool holders and tools may have respective interlocking safety keys and key-receiving grooves to restrain accidental dropping of tools once the clamp of the holder has been loosened. Forming tools can in some instances be removed downwardly from the holder once the clamp is loosened, and in other instances the forming tool must be removed by horizontally sliding it from the holder. If a forming tool of some length (and hence of some substantial weight) is to be replaced, it sometimes is difficult to slide the forming tool horizontally from its holder because of the proximity of neighboring forming tools which may themselves have to be removed in order to complete the tool exchange process. Because long forming tools can be quite heavy, when a clamp is loosened to the point that the tool can be removed by moving it downwardly, care must be taken to prevent the tool from slipping from the tool holder and falling.

Various press brake tool holders have been devised in an effort to facilitate the exchange of one forming tool for another. Examples of the tool holders of this type are shown in U.S. Pat. Nos. 5,513,514, 5,511,407 and 5,572,902. More recent tool holders are described in U.S. Pat. Nos. 6,003,360, 5,245,854, and 6,467,327.

U.S. Pat. No. 5,619,885, the disclosures of which are incorporated herein by reference, shows a press brake tool and tool holder in which the tang of the tool is provided with a vertical sliding surface that slides against a vertical surface of a plate of the holder. The reverse side of the tang is provided with a slanted planar surface that diverges downwardly from the vertical surface. The holder and tool also have engagable, generally horizontal, force-transmitting surfaces for transmitting vertical forces between the upper table and the tool. The slanted surface of the tang is designed to come into surface-to-surface contact with a clamp element of the tool holder when the tool is pushed upwardly into the holder. Because of this slanted configuration of the tang, the clamp of the tool holder is forced open when the tool is forced upwardly between the plate and clamp. As the tool is pushed upwardly, a lip on the clamp engages a safety-groove formed in the tool. The force exerted by the clamp upon the tang has a horizontal component to clamp the tang against the vertical surface of the holder plate, but this force also has a downwardly directed component. Clamps and tools of this type generally are known as "Amada style", and are commonly sold under the trademark "One Touch".

Other Press brake tools and tool holders are shown in U.S. Pat. Nos. 6,138,492 and 6,557,390, both of which are assigned to the assignee of the present invention. See also U.S. Pat. No. 6,564,611. A summary of certain types of press brake tools and tool holders is provided in U.S. Pat. No. 6,467,327, the contents of which are incorporated herein by reference also. U.S. Pat. No. 6,003,360, assigned to the assignee of the present application, shows a tool holder manufactured by Wilson Tool International, Inc. and sold under the registered trademark "Express®". Note should be made that the tangs of the press brake tools described in this patent are exemplified as being generally rectangular in cross-section, as compared to the generally wedge-shaped or slanted tangs of the Amada-type tools shown in U.S. Pat. No. 5,619,885.

It would be beneficial to provide a press brake tool that on the one hand would be configured to be forced upwardly by the tool holder clamp as the clamp is forced against the tang, and which on the other hand would be appropriate for use in both Amada-style and Wilson-style tool holders.

SUMMARY OF THE INVENTION

A press brake tool is provided having a body that terminates downwardly in a work piece engaging surface and that includes a tang extending upwardly from the body for reception in a tool holder. The tang has a first wall defining a vertical surface for engagement with a cooperating vertical surface of a tool holder, and the tang has a second wall on the reverse side of the tang that defines an arcuate, concave surface. The concave surface includes an upper contact surface that is tangent to a plane that is downwardly convergent with respect to the vertical surface such that a force delivered to that contact surface includes an upward component tending to lift the tang into the tool holder.

In a preferred embodiment, the arcuate surface is formed on a plurality of radii formed on spaced horizontal axes and including an upper radius and a lower radius, the upper radius being smaller than the lower radius.

DETAILED DESCRIPTION

Figure 1:
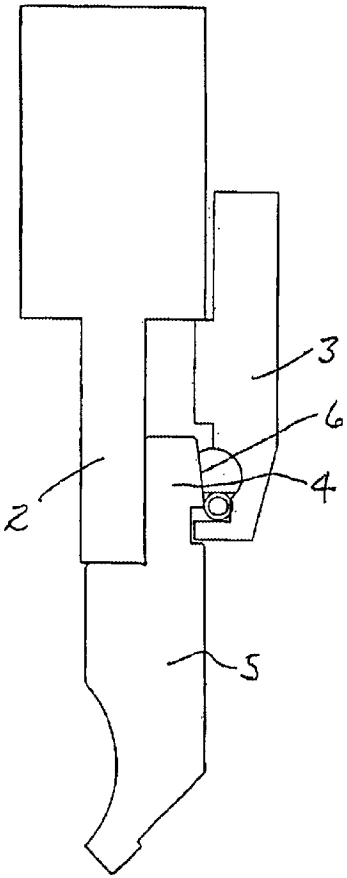
FIG.1 (Prior Art)
FIG. 1 is a schematic end-view of a prior art Amada-style press-brake tool and tool holder.

As background, FIG. 1 shows an Amada-style tool and tool holder, the tool holder having a vertical mounting plate 2 and a clamp 3. The tang 4 of a press brake tool 5 has a slanted surface 6 so configured that when the tool is forced upwardly between the plate and the clamp, the clamp is cammed open by the slanted surface 6. The holder is generally of the type shown in U.S. Pat. No. 5,619,885, assigned on its face to Amada Metrecs Company, Ltd.

Figure 2:
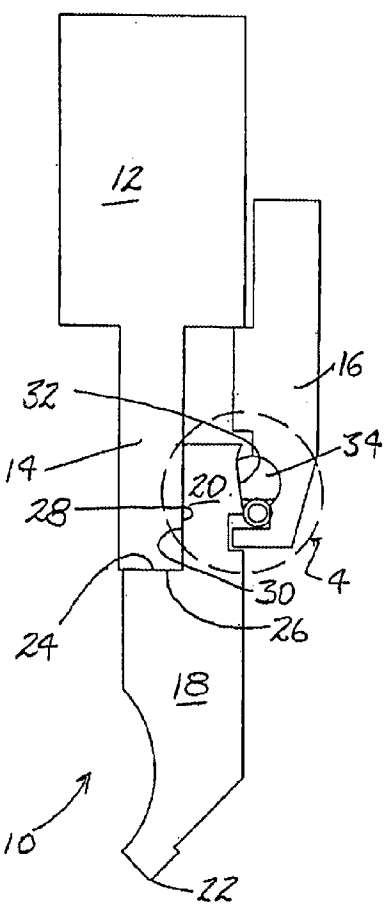
FIG. 2 is a schematic end-view of a press-brake tool of the invention together with an Amada-style tool holder.

Referring now to FIG. 2, a similar press brake tool holder is shown having a body 12, a downwardly extending plate 14 and a clamp 16. It will be understood that in certain of these schematic views of well known press brake tool holders, the structure holding the clamp 16 to the remainder of the holder has been omitted. It should be understood that the omitted structure is such that the clamp 16 generally pivots about its connection to the holder 12 such that the lower portion of the clamp is moved generally horizontally toward and away from the support plate 14. In the current commercial embodiment of the tool holder shown in FIG. 2, the tool holder includes a lever which is movable by the operator to pivot the clamp toward and away from the plate 14.

Figure 3:
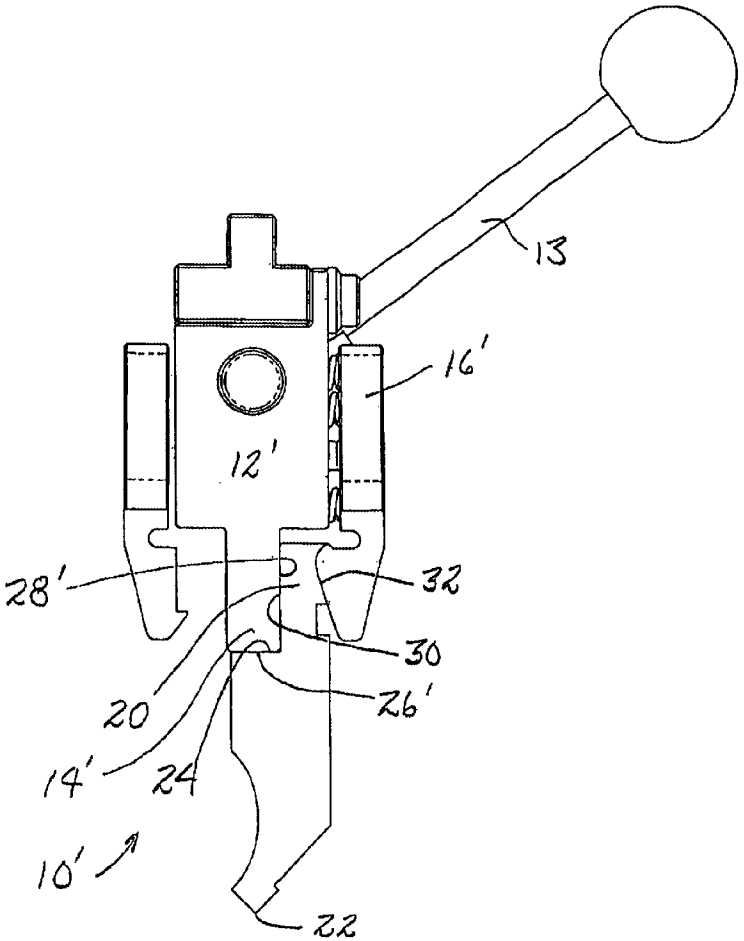
FIG. 3 is a schematic end-view of another embodiment of a press-brake tool of the invention as received within a Wilson-style tool holder.

In FIG. 3, the holder, which is of the Wilson type, includes a body 12' that includes a support plate 14' and a clamp 16', the clamp being pivotally attached to the body 12. A lever 13, movable parallel to the plane of the paper, can be operated by the operator to move the lower end of the clamp toward and away from the plate 14.

FIGS. 2 and 3 depict press brake tools that are substantially different from the slanted tool shown in FIG. 1. Each tool has a body portion 18, an upwardly extending tang 20 adapted to be received between the support plate and the clamp of a press brake tool holder, and a lower, work engaging surface 22. The tools themselves include generally horizontal, upwardly facing shoulders 24 that engage complementary downwardly facing surfaces 26 of the tool holder's support plate 14, 14', the surfaces serving to transmit force downwardly from the upper table (not shown) to the press brake tools 10, 10' of FIGS. 2 and 3. Moreover, the tool holder support plates 14, 14', respectively of the embodiments of FIGS. 2 and 3 each have vertical surfaces 28, 28' that engage vertical surfaces 30 of the tangs 20. As shown in FIGS. 2 and 3, as the tools 10, 10' are moved upwardly, the surfaces 28, 30 (FIG. 2) and 28', 30 (FIG. 3) come into surface to surface contact. As teach tool moves upwardly, its shoulder 24 comes into contact with and is locked against the bottom surface 26, 26' of the support plate.

Figure 5:
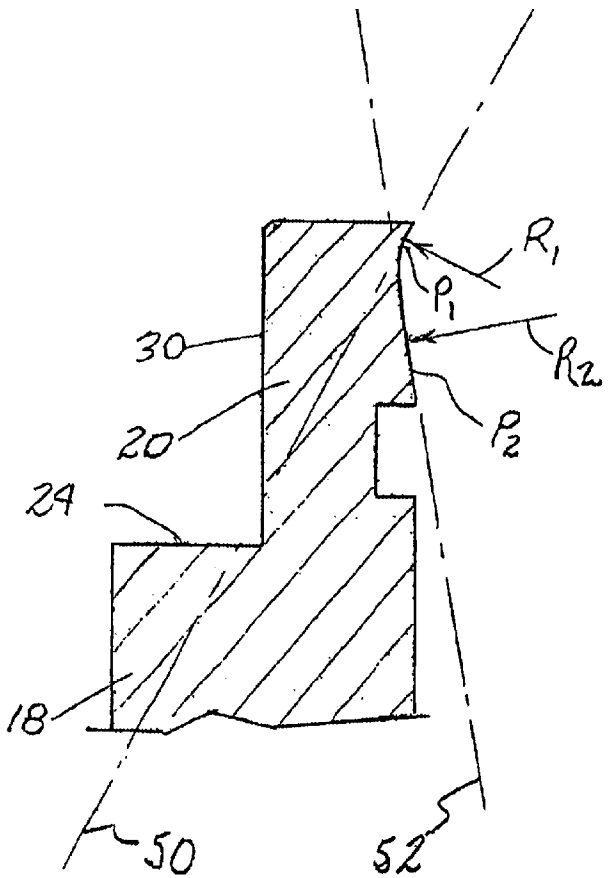
FIG. 5 is a broken away cross-section of a portion of a press-brake tool of the invention.
Figure 4:
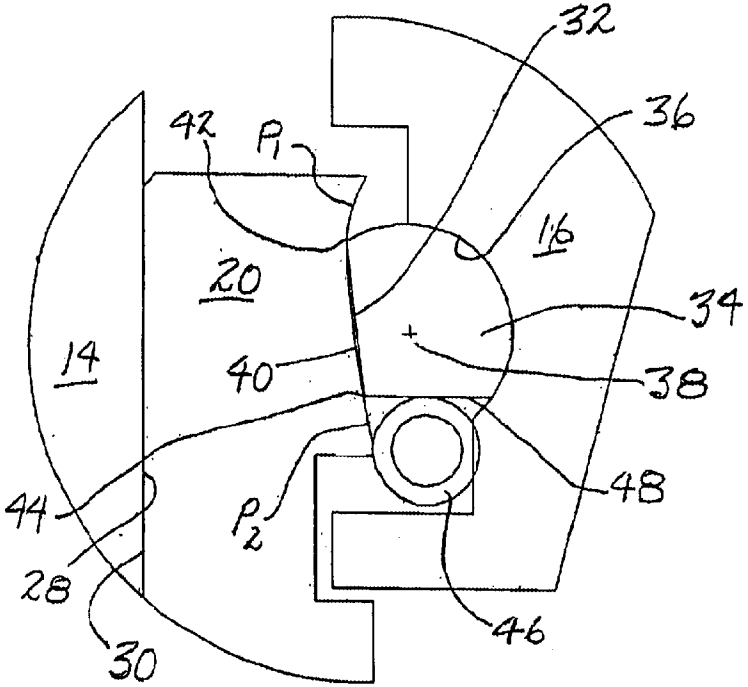
FIG. 4 is an enlarged view of the circled portion of FIG. 2.

The reverse surface 32 of the tang has an arcuate, concave shape, and is described best with reference to FIGS. 4 and 5, to which we now turn.

Referring to FIG. 5, the tang portion 20 of a tool of the invention is shown in cross section. Its arcuate surface 32, the reverse of the surface 30, is formed desirably on a plurality of radii about spaced horizontal axes. In FIG. 5, the upper portion of the arcuate surface—that indicated at point $P_1$—is formed on a radius $R_1$, whereas the lower portion of the arcuate surface indicated at $P_2$ is formed about a larger radius $R_2$. That is, the radius upon which different portions of the arcuate surface 32 is formed is smallest near the top of that surface and largest at the bottom of that surface, in a desired embodiment.

Referring to FIG. 4, which is an enlargement of the circled portion 4 in FIG. 2, the tool holder clamp 16 includes a horizontally extending rod 34 that is received within a generally circular groove 36 of the clamp and hence can rotate within the clamp about an axis 38. A portion of the surface of the rod is planar, as shown at 40, that planar surface intersecting the generally cylindrical outer surface of the rod at edges 42, 44. As the clamp is forced against the surface 32 of the tang, its edges 42, 44 come into contact with the arcuate surface of the tang at $P_1$, $P_2$, respectively. Slight rotation of the rod 34 distributes the load between the edges 42, 44. A horizontally extending helical spring 46 supports the rod 34 and bears upwardly against a second flat surface 48 of the rod.

Referring again to FIG. 5, $P_1$ represents the upper contact surface of the arcuate surface 32 that is contacted by the point 42 of the rod 34 as the clamp engages the arcuate surface of the tang. Similarly, $P_2$ represents the lower contact surface that is engaged by the point 44 of the rod. It will be understood that the edges 42, 44 of the rod are shown as points in the side view of FIG. 4, these points actually represent lines that are the intersection of the planar surface 40 and the generally cylindrical surface of the rod, and that $P_1$ and $P_2$ represent lines on the arcuate surface of the tang that are contacted by the respective intersections 42, 44.

Referring to FIG. 5, one may draw a plane 50 that is tangent to the arcuate surface of the tang at $P_1$, and another plane 52 that is tangent to the arcuate surface at point $P_2$. Whereas plane 50 is convergent downwardly with respect to the vertical surface 30 of the tang, the plane 52 is convergent upwardly with that surface. From the standpoint of force vectors, a force delivered by the edge 42 of the rod 34 at point $P_1$ will act normal to the tangent 50, and the force thus will have a horizontal component and a vertical component. The vertical component urges the tang upwardly when the tang is clamped in the tool holder. Similarly, the force exerted by the clamp at point $P_2$ will act normal to the plane 52, and that force will have horizontal and vertically downward components. Inasmuch as the angle between the vertical surface 30 and plane 50 is greater in absolute value than the angle between the vertical surface 30 and the plane 52, the upward component of force acting at $P_1$ will be greater than the downward component of force acting at point $P_2$, with the net vertical force then being upward. This assumes that the force delivered at $P_1$ and $P_2$ will be essentially equal, and the latter condition is a result of the slight rotation of the rod 34 as it comes into contact with the arcuate surface of the tang.

FIG. 3 shows another embodiment of a tool and tool holder of the invention. Here, the arcuate surface 32 of the tool holder is formed generally as shown in FIG. 5, but the portion of the clamp 16' that engaged the arcuate surface of the tang is shaped to be at least partially congruent with that arcuate surface, as shown in FIG. 3. As thus illustrated, the curved surface of the clamp that fits congruently against the, upper arcuate surface of the tang exerts a net upward force against the upper surface of the tang.

The use of an arcuate surface 32 of the tang against which the clamp presses, as opposed to a flat surface, for example, assures that the force exerted by the clamp will act in a direction normal to the tangent of a plane drawn to that portion of the arcuate surface contacted by the clamp. The distribution of force components against the arcuate tang can be readily varied as desired by changing the degree of curvature of the tang to thus change the angle that the planes 50, 52 make with the vertical. Radius $R_2$ may be several times greater than $R_1$, and will act about a horizontal axis spaced (in FIG. 5) far to the right of that figure and accordingly not shown in FIG. 5. For example, the radius $R_1$ may be on the order of one inch, whereas the radius $R_2$ may be on the order of four inches. The surfaces that are generated by these radii about their axes desirably merge smoothly into one another, and of course other radii may appropriately be employed to sweep out other areas of the arcuate surface, it being desired that the curve of the arcuate surface of the tang be smooth and without abrupt surface changes.

While a preferred embodiment of the present invention has been described, it should be understood that various changes, adaptations and modifications may be made therein without departing from the spirit of the invention and the scope of the appended claims.

What is claimed is:

1. A press brake tool having a body terminating downwardly in a workpiece-engaging surface and a tang extending upwardly from the body and adapted for reception in a tool holder, the tang having a first wall defining a vertical surface and a second wall on the opposite side of the tang defining an arcuate, concave surface, the concave surface including an upper contact surface tangent to a plane that is downwardly convergent with respect to said vertical surface.

2. The press brake tool of claim 1 wherein said concave surface includes a lower contact surface that is beneath said upper contact surface and that is tangent to a plane that is upwardly convergent with respect to said vertical surface.

3. The press brake tool of claim 2 wherein said upper contact surface includes a portion formed on a radius $R_1$ about a first horizontal axis, wherein said lower contact surface includes a portion formed on a radius $R_2$ about a second horizontal axis parallel to the first horizontal axis, and wherein $R_1<R_2$.

4. The press brake tool of claim 3 wherein said concave surface is formed on a plurality of radii about a plurality of mutually parallel horizontal axes, respectively.

5. The press brake tool of claim 2 including a downwardly open tool holder for receiving and clamping said tool, said holder including a support plate for receiving and supporting the vertical wall of the tool tang, and a clamp movable between open and clamping positions, said clamp having a portion engagable with said concave surface of the tool tang to urge the vertical wall of the tool tang against the support plate.

6. The press brake tool of claim 5 wherein said tool and tool holder include cooperating upwardly facing and downwardly facing force-transmitting surfaces, respectively, and wherein said clamp portion includes a first clamping surface engageable with the upper contact surface of the tool tang to impart to the tang a force having an upwardly directed force component to urge said force transmitting surfaces together when the clamp in moved into its clamping position.

7. The press brake tool of claim 6 wherein said clamp portion includes a second clamping surface engagable with the lower contact surface of the tool tang to impart to the tang a force having a downwardly directed vector component to force said vertical surface of the tang against the support plate of the holder when the clamp is moved into its clamping position, said upwardly directed vector component being greater than said downwardly directed vector component.

8. The press brake tool of claim 7 wherein said first and second clamping surfaces are joined by a substantially planar surface.

9. The press brake tool of claim 7 wherein said clamp includes a horizontally extending rod rotatable about a horizontal axis within a complementary groove formed in the clamp, said lip having a generally cylindrical exterior surface and a planar surface segment intersecting said generally cylindrical surface at said first and second clamping surfaces, respectively.

10. A press brake tool having a body terminating downwardly in a workpiece-engaging surface and a tang extending upwardly from the body portion and adapted for reception in a tool holder, the tang having a first wall defining a vertical surface and a second wall on the opposite side of the tang defining an arcuate, concave surface, the concave surface including an upper portion contact surface tangent to a first plane that is downwardly convergent with respect to said vertical surface and a lower portion contact surface tangent to a second plane that is upwardly convergent with respect to said vertical surface, the angle between the vertical and said first plane being greater than the angle between the vertical and the second plane.

11. The press brake tool of claim 10 wherein said upper contact surface is formed on a radius $R_1$ about a first horizontal axis, wherein said lower contact surface is formed on a radius $R_2$ about a second horizontal axis parallel to the first horizontal axis, and wherein $R_1<R_2$.

12. The press brake tool of claim 10 including a tool holder for said tool, the tool holder including a vertical surface engagable with the vertical surface of the tang, and a clamp having a clamping portion engagable with said upper contact portion of the tang to impart to the tang a force having an upwardly directed force component to urge said tang upwardly within the tool holder.

13. The press brake tool and tool holder of claim 12 wherein said clamp includes a second clamping portion engagable with said lower contact surface to impart to the tang a downwardly directed force component of lesser magnitude than the upwardly directed force component.

14. The press brake tool and tool holder of claim 13 wherein said first and second clamping portions are separated by a planar portion.

15. The press brake tool and tool holder of claim 13 wherein said clamp includes a portion that is substantially congruent with the arcuate, concave surface of the tang and that includes said upper and lower clamping portions.

* * * * *